US006870164B1

(12) United States Patent
Baldwin et al.

(10) Patent No.: US 6,870,164 B1
(45) Date of Patent: Mar. 22, 2005

(54) PULSED OPERATION OF HALL-CURRENT ION SOURCES

(75) Inventors: David A. Baldwin, Annandale, VA (US); Boris Ciorneiu, Great Falls, VA (US); Harold R. Kaufman, LaPorte, CO (US)

(73) Assignees: Kaufman & Robinson, Inc., Ft. Collins, CO (US); Veeco Instruments Inc., Plainview, NY (US)

( * ) Notice: Subject to any disclaimer, the term of this patent is extended or adjusted under 35 U.S.C. 154(b) by 663 days.

(21) Appl. No.: 09/689,476

(22) Filed: Oct. 12, 2000

Related U.S. Application Data

(60) Provisional application No. 60/159,821, filed on Oct. 15, 1999.

(51) Int. Cl.[7] ..... H01J 27/00
(52) U.S. Cl. ..... 250/423 R
(58) Field of Search ..... 250/423 R

(56) References Cited

U.S. PATENT DOCUMENTS 4,481,062 A * 11/1984 Kaufman et al. ..... 156/345.39
4,862,032 A * 8/1989 Kaufman et al. ..... 313/359.1
5,763,989 A * 6/1998 Kaufman ..... 313/361.1
5,973,447 A * 10/1999 Mahoney et al. ..... 313/359.1
6,075,321 A * 6/2000 Hruby ..... 315/111.91
6,086,962 A * 7/2000 Mahoney et al. ..... 427/577
6,368,678 B1 * 4/2002 Bluck et al. ..... 427/569
6,449,941 B1 * 9/2002 Warboys et al. ..... 60/202
6,456,011 B1 * 9/2002 Bugrova et al. ..... 315/111.91
2002/0163289 A1 * 11/2002 Kaufman et al.

FOREIGN PATENT DOCUMENTS

WO WO 97/37126 * 10/1997
WO WO 97/37127 * 10/1997

* cited by examiner

*Primary Examiner*—John R. Lee
*Assistant Examiner*—Johnnie L Smith, II
(74) *Attorney, Agent, or Firm*—Dean P. Edmundson

(57) ABSTRACT

In accordance with one specific embodiment of the present invention, a Hall-current ion source is operated in a pulsed mode where the pulse duration is short compared to the time for discharge fluctuations to develop. For a reduced loss of neutral gas, the time between pulses should be less than, or about equal to, the fill time for the ionizable gas in the discharge volume of the Hall-current ion source.

9 Claims, 4 Drawing Sheets

PULSED OPERATION OF HALL-CURRENT ION SOURCES

CROSS-REFERENCE TO RELATED APPLICATION

This application is based upon, and claims the benefit of, our Provisional Application No. 60/159,821, filed October 15, 1999.

FIELD OF INVENTION

This invention relates generally to ion and plasma sources, and more particularly it pertains to plasma and ion sources that utilize a Hall current in the generation of the electric field that accelerates ions in a neutral plasma.

The invention can find application in industrial applications such as sputter etching, sputter deposition, coating and property enhancement. It can also find application in electric space propulsion.

BACKGROUND ART

The acceleration of ions to form energetic beams of ions has been accomplished both electrostatically and electromagnetically. The present invention pertains to sources that utilize electromagnetic acceleration. Such sources have variously been called plasma, electromagnetic, and gridless ion sources. Because the ion beams are typically dense enough to require the presence of electrons to avoid the disruptive mutual repulsion of the positively charged ions, the ion beams are also neutralized plasmas and the ion sources are also called plasma sources.

In ion sources (or, in space propulsion, thrusters) with electromagnetic acceleration, there is a discharge between an electron-emitting cathode and an anode. The accelerating electric field is established by the interaction of the electron current in this discharge with a magnetic field created between the anode and cathode. This interaction generally includes the generation of a Hall current normal to both the magnetic field direction and the direction of the electric field that is established. For the Hall current to be utilized efficiently, it must take place in a closed path within the discharge volume.

A Hall-current ion source can have a circular acceleration channel with only an outside boundary, where the ions are accelerated continuously over the circular cross section of this channel. This type of Hall-current ion source usually has a generally axial magnetic field shape as shown in U.S. Pat. No. 4,862,032—Kaufman et al, and as described by Kaufman, et al., in *Journal of Vacuum Science and Technology A*, Vol. 5, No. 4, beginning on page 2081. These publications are incorporated herein by reference.

A Hall-current ion source can also have an annular acceleration channel with both inner and outer boundaries, where the ions are accelerated only over an annular cross section. This type of Hall-current ion source usually has a generally radial magnetic field shape as shown in U.S. Pat. No. 5,359,258—Arkhipov, et al., and U.S. Pat. No. 5,763,989—Kaufman, and as described by Zhurin, et al., in *Plasma Sources Science & Technology*, Vol. 8, beginning on page R1. These publications are also incorporated herein by reference.

The cross sections of the acceleration channels are described above as being circular or annular, but it should be noted the cross sections can have other shapes such as an elongated or "race-track" shape. Such alternative shapes are described in the references cited. It should also be noted that the magnetic field shape can depend on the desired beam shape. For example, a radially directed ion beam would have a magnetic field generally at right angles to the magnetic field used to generate an axially directed ion beam.

There are inherent limitations of the Hall-current ion sources described above. One is the loss of neutral (unionized) gas that accompanies the generation of ions. The need for this loss can be described in a fairly simple manner. The ions are generated in a neutral plasma. During the time between the generation of a single ion and its departure from the region of generation, steady-state operation requires that a new ion be generated to replace it. At the same time, plasma neutrality requires that, on the average, only one electron is available to generate this replacement by ionizing a neutral atom or molecule. With the time for a single ionization by a single electron fixed, there is a minimum neutral density that will assure that the replacement ion is generated. The minimum neutral density to sustain the discharge results in a loss of neutral gas through the channel in which the ions are accelerated.

Another inherent limitation of a Hall-current ion source is the effect of background pressure on the maximum operating voltage, and hence on the maximum attainable ion energy. When the background pressure is significant, some of the neutral gas that is ionized comes from the backflow of neutrals from the background into the ion source. To compensate for this backflow at a given combination of discharge voltage and current, the external flow of neutral gas to the ion source must be reduced. The backflow thus results in an increase in neutral gas density near the exit plane and a decrease in neutral gas density near the anode, where the external flow of neutral gas is introduced. This shift in density distribution results in a corresponding shift in plasma density. More specifically, the reduction in plasma density near the anode reduces the ability of this plasma to sustain a discharge current. When the decrease in plasma density near the anode is sufficiently large due to the backflow of background gas, the discharge will at first fluctuate, or become "noisy," and then will extinguish. The fluctuations in a noisy plasma are an aggravating factor in that they permit energetic electrons to more readily diffuse across the magnetic field and reach the anode, thereby being less effective in the generation of ions. In general, an increase in background pressure results in a decrease in the permissible maximum discharge voltage, and therefore the permissible maximum ion energy.

The escape of neutral gas and the effect of background pressure have serious adverse effects on ion source operation. The required pumping to sustain a given background pressure is increased by the loss of neutral gas. There is a necessary pumping that is required to offset the ion beam. That is, the ions will strike a target, recombine with electrons and become neutrals. The pumping must have sufficient capacity to carry away neutrals from these recombined ions and maintain the desired background pressure. The additional flow of neutral gas directly from the ion source adds to the required pumping capacity.

Sensitivity to background pressure can also add to the required pumping capacity. If two ion sources have the same ion beam currents and the same loss rate of neutral atoms or molecules of gas, the one that requires a lower background pressure for operation will also require more pumping capacity. To minimize the required pumping, it is desirable that an ion source tolerate a high background pressure.

Although space propulsion applications generally have negligible background pressure, the loss of neutral gas is serious and has a direct and adverse effect on overall efficiency.

The prior art summarized above all uses direct-current (dc) operation of ion sources. There have been limited departures from dc, or steady-state, operation in prior art. One departure has been short pulses when a very small amount of thin-film processing is required. Very short pulses have also been used in space propulsion when a very small impulse (the product of thrust times time) is required. Another departure from dc operation has been switching back and forth from one ion source to another to use multiple ion sources for thin-film processing while avoiding adverse interactions that might be encountered while operating two ion sources simultaneously. Yet another departure has been the use of quasisteady pulsed operation to determine the performance of an ion source or thruster with test facilities inadequate to sustain steady-state operation. In none of these prior-art departures from steady-state operation of Hall-current ion sources or thrusters have differences in electrical discharges been described compared to steady-state operation.

SUMMARY OF INVENTION

In light of the foregoing, it is an overall general object of the invention to provide a Hall-current ion source with improved operating characteristics.

A more specific object of the present invention is to provide a Hall-current ion source with a reduced loss of neutral gas.

A further object of the present invention is to provide a Hall-current ion source with a reduced sensitivity to background pressure.

Yet another object of the present invention is to provide a Hall-current ion source with improved ionization and acceleration efficiencies.

Still another object of the present invention is to provide a Hall-current ion source with increased efficiency of operation at small ion beam currents.

In accordance with one specific embodiment of the present invention, a Hall-current ion source is operated in a pulsed mode where the pulse duration is short compared to the time for discharge fluctuations to develop. For a reduced loss of neutral gas, the time between pulses should be less than, or about equal to, the fill time for the ionizable gas in the discharge volume of the Hall-current ion source.

DESCRIPTION OF FIGURES

Features of the present invention which are believed to be patentable are set forth with particularity in the appended claims. The organization and manner of operation of the invention, together with further objectives and advantages thereof, may be understood by reference to the following descriptions of specific embodiments thereof taken in connection with the accompanying drawings, in the several figures of which like reference numerals identify like elements and in which:

It may be noted that the aforesaid schematic views represent the surfaces in the plane of a cross section while avoiding the clutter which would result were there also a showing of the background edges and surfaces of the overall generally-cylindrical assemblies.

DESCRIPTION OF PRIOR ART

Figure 1:
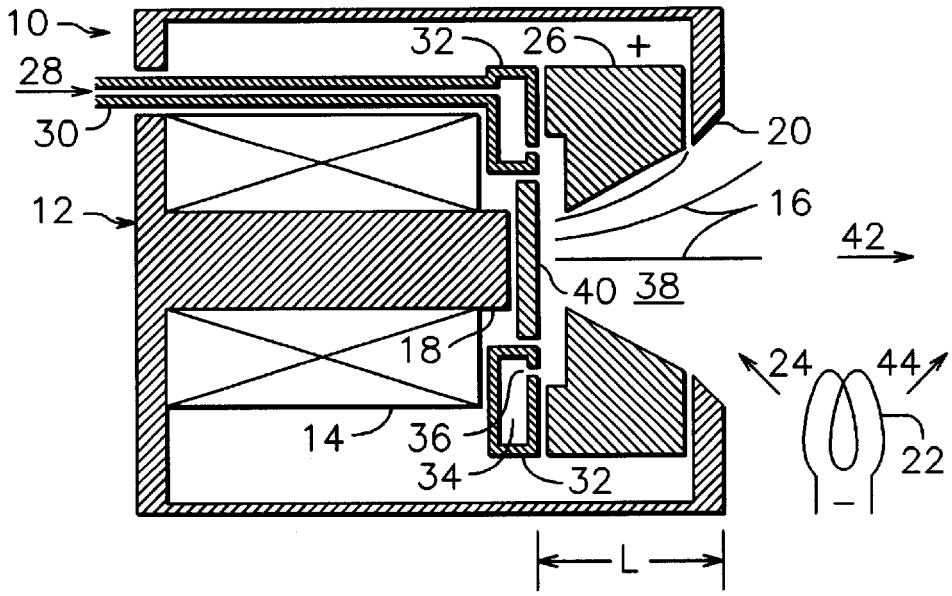
Fig. 1 (PRIOR ART)
FIG. 1 is a schematic cross-sectional view of a prior-art Hall-current ion source of the end-Hall type.

Referring to FIG. 1, there is shown an approximately axisymmetric Hall-current ion source of the prior art, more particularly one of the end-Hall type. Ion source 10 includes a generally-cylindrical magnetically permeable path 12, which is magnetically energized by magnet coil 14. Magnetic field 16 (shown only on one side of the axis of symmetry to reduce the clutter in FIG. 1) is thereby generated between inner pole piece 18 and outer pole piece 20. Electron-emitting cathode 22 emits electrons 24 which flow toward the anode 26. Ionizable gas 28 is introduced into ion source 10 through tube 30 which connects to manifold 32, which has an interior volume 34 to circumferentially distribute the gas to apertures 36, which in turn permit a flow of gas to discharge volume 38 enclosed laterally by anode 26 and at one end by reflector 40. Electrons 24 are constrained by magnetic field 16 so that they cannot flow directly to anode 26, but remain in discharge volume 38 until, through collision processes, they can diffuse across the magnetic field. Some of the collisions are with neutral atoms or molecules of the ionizable gas and generate ions, which are accelerated in the axial direction to become ion beam 42. Additional electrons 44 from cathode 22 charge and current neutralize the ion beam. With the exception of the cathode 22 and the tube 30, the configuration shown is axially symmetric.

Figure 2:
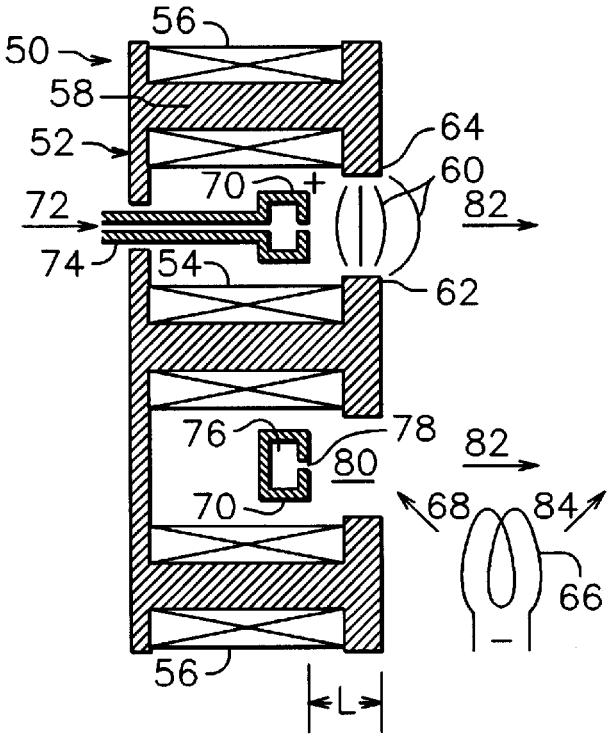
Fig. 2 (PRIOR ART)
FIG. 2 is a schematic cross-sectional view of a prior-art Hall-current ion source of the closed-drift type.

Referring now to FIG. 2, there is shown another approximately axisymmetric Hall-current ion source of the prior art, more particularly one of the closed-drift type. Ion source 50 includes a generally-cylindrical magnetically permeable path 52, which is magnetically energized by magnet coils 54 and 56. In the usual construction, the magnetic paths 58 through outer magnet coils 56 are four equally-spaced discrete paths, rather than being strictly axially symmetric. Magnetic field 60 (shown only on one side of the axis of symmetry to again reduce the clutter) is thereby generated between inner pole piece 62 and outer pole piece 64. Electron-emitting cathode 66 emits electrons 68 which flow toward the anode 70. Ionizable gas 72 is introduced into ion source 50 through tube 74 which connects to anode 70, which is also a gas distribution manifold with an interior volume 76 to circumferentially distribute the gas to apertures 78, which in turn permit a flow of the gas to discharge volume 80 enclosed laterally by inner and outer pole pieces 62 and 64 and at one end by anode 70. Electrons 68 are constrained by magnetic field 60 so that they cannot flow directly to anode 70, but remain in discharge volume 80 until, through collision processes, they can diffuse across the magnetic field. Some of the collisions are with neutral atoms or molecules of ionizable gas and generate ions, which are accelerated in the axial direction to become ion beam 82.

Additional electrons 84 from cathode 66 charge and current neutralize the ion beam. With the exception of the tube 74, the outer magnet coils 56 and the permeable paths therein 58, the configuration shown is axially symmetric.

A variety of electron-emitting cathode types could be used for the prior-art Hall-current ion sources shown in FIGS. 1 and 2. As indicated schematically therein, the cathodes could be of the hot-filament type, where an external power source is required to increase the filament temperature to an emissive level. A hot filament must be within the ion beam to establish good electrical contact with the plasma. Hollow cathode or plasma-bridge cathodes could also be used. In both cases, there is a conductive plasma plume emitted by the cathode that permits good electrical contact with the ion beam when the cathode is located outside of the ion beam. These alternate cathode types are mentioned to show that there is no intent of limiting the invention to only one cathode type.

Figure 3:
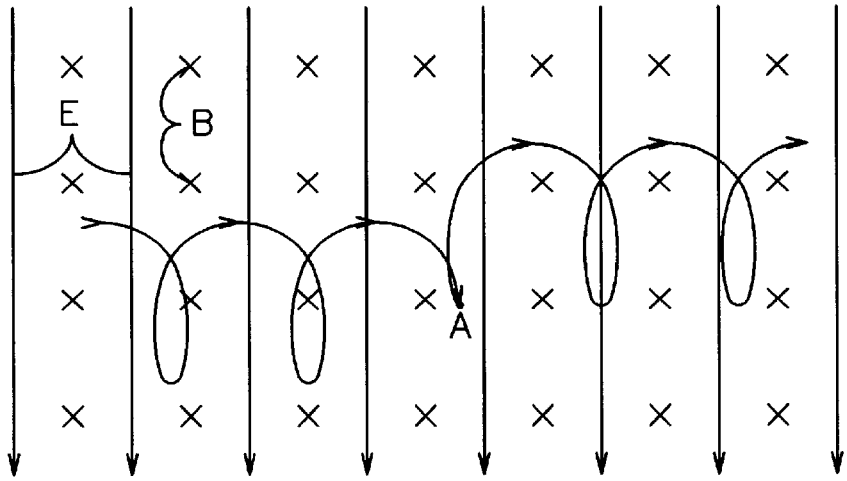
Fig. 3 (PRIOR ART)
FIG. 3 is a schematic representation of electron diffusion across a magnetic field in prior-art Hall-current ion sources.

Referring next to FIG. 3, there is shown a schematic representation of an electron diffusing across a magnetic field. The electric field E is shown directed downward, consistent with the positive anode being located at the top of FIG. 3 and the negative electron-emitting cathode being located at the bottom. The magnetic field B is directed normal to the paper. Under the combined effects of the electric and magnetic fields, an electron moves from left to right and follows a curved cycloidal path as indicated in FIG. 3 In the absence of a collision, the electron would drift normal to the directions of both the electric and magnetic fields. The electron undergoes a collision at point A in FIG. 3. The path after the collision will depend both on the nature of the collision and the point in the path of the electron where the collision takes place. On the average, the collision will shift the electron to a path that is closer to the anode, as indicated by the path to the right of point A in FIG. 3.

Successive collisions of the type indicated in FIG. 3 will permit an electron to diffuse from close to the axis to the anode in the end-Hall ion source shown in FIG. 1 or from the downstream side of the pole pieces (closer to the cathode) to the anode in FIG. 3. While collisions of electrons with neutral gas atoms or molecules are necessary to generate ions and therefore necessary for the operation of a Hall-current ion source, there are other collision processes that are not necessary. In particular, potential and density fluctuations in the plasma that are associated with a "noisy" discharge can also deflect electrons and add to their diffusion across the magnetic field. There is a discussion of a variety of oscillations or fluctuations in discharge parameters in the aforementioned article by Zhurin, et al. It should be noted that there are usually a variety of oscillations that are simultaneously present in a discharge. Thus while some dominant frequency may be evident, there is also a stochastic quality to the variations.

While calculations have been made for some of the possible mechanisms, the effects of these fluctuations are, for the most part, made evident by the decreased performance of a Hall-current ion source that exhibits large fluctuations. For a given discharge voltage and current, large fluctuations result in a decrease in the ion current that is generated, a decrease in the mean energy of those ions, and an increase in the loss of neutral gas.

Figure 4:
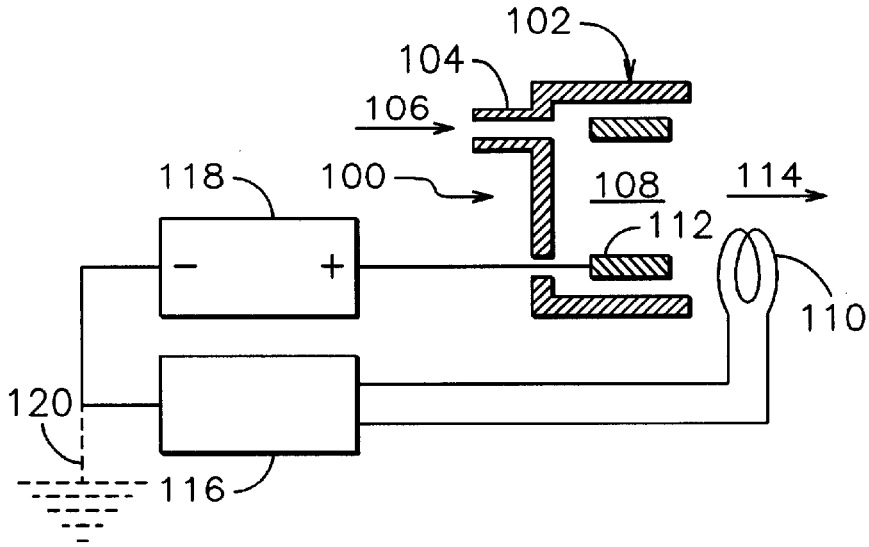
Fig. 4 (PRIOR ART)
FIG. 4 is a prior-art schematic representation of a Hall-current ion source together with associated power supplies. The magnetic field is not shown.

Referring now to FIG. 4, there is shown a schematic representation of a Hall-current ion source, of either the end-Hall or closed-drift types, together with its power supplies. The magnetic field is omitted in this generalized representation of a Hall-current ion source. The ion source 100 includes an outer enclosure 102, a gas-flow tube 104 through which ionizable gas 106 is introduced to the discharge volume 108. A discharge is established between electron-emitting cathode 110 and anode 112, which in turn generates ion beam 114. Cathode power supply 116 provides the current(s) and voltage(s) necessary for the operation of the cathode. For a hot-filament cathode, a sufficient heating power would be provided to assure the desired level of emission. For a hollow cathode, a power sufficient to start the operation would be provided and, depending on the particular configuration and operating condition, possibly also a heating power to maintain the cathode at operating temperature and a secondary discharge circuit to maintain the capability of electron emission when there is no discharge. For a plasma-bridge cathode, there would be a heating power for an internal hot filament, a secondary circuit to maintain an internal discharge within the plasma-bridge cathode, and a tertiary circuit to bias the plasma-bridge to a negative voltage sufficient to provide the proper emission. In the case of a hollow cathode or a plasma-bridge cathode, there would also be a secondary flow of ionizable gas to the cathode that is not shown in FIG. 4. As in the discussion of the Hall-current ion sources shown in FIGS. 1 and 2, there is no intent or need to limit this invention to a particular cathode type.

Discharge supply 118 in FIG. 4 is of the direct-current (dc) type. Output filters (not shown in FIG. 4) consisting of various combinations of resistors, capacitors, and/or inductors have been used to reduce the amplitude of the oscillations in voltage and current that occur at the output of discharge supply 118.

An optional electrical ground connection 120 is shown in FIG. 4. In an industrial application, this ground is assumed to be a metallic vacuum chamber which is normally connected to earth ground. If the current from the cathode 110 to the power supply 118 (due to electron emission from the cathode) is equal to, or slightly larger than, the current from the power supply 118 to the anode 112, the cathode potential will be close to ground potential, even if this ground connection is not made. In this case operation of the ion source will be normal.

DESCRIPTION OF THE PREFERRED EMBODIMENTS

Figure 5:
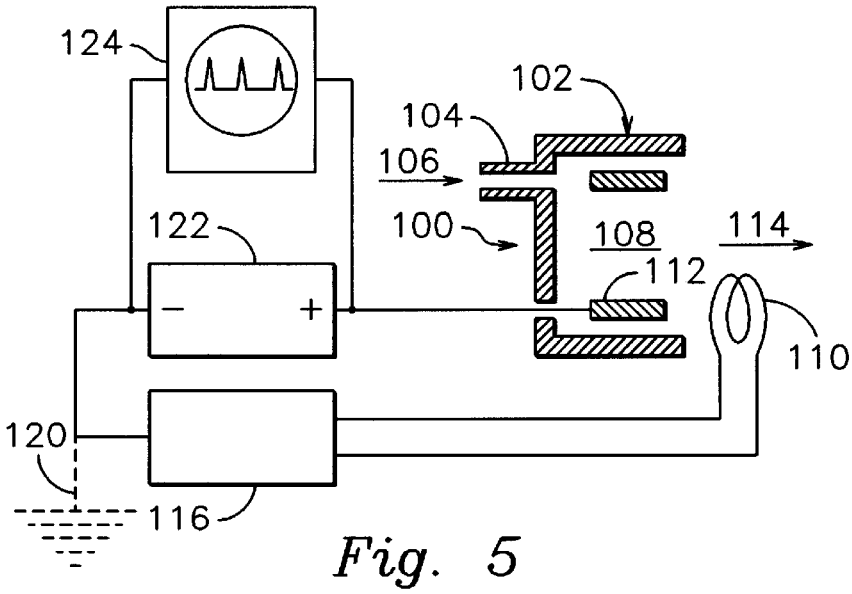
FIG. 5 is a schematic representation of a Hall-current ion source constructed in accord with one embodiment of the present invention. The magnetic field is not shown.

FIG. 5 sets forth a preferred embodiment of the present invention in which the operation is generally similar to that described in connection with FIG. 4. The magnetic field is again omitted in this generalized representation of a Hall-current ion source. The only difference is that the dc power supply 118 in FIG. 4 is replaced with pulsed power supply 122 that delivers a series of positive pulses as indicated by oscilloscope 124. There can also be negative pulses delivered to the anode, but only the positive ones are important because no discharge will occur during the negative pulses.

For the operation of the Hall-current ion source of FIG. 5 to have the beneficial characteristics of the present invention, it is necessary for the pulses from power supply 122 to have certain characteristics.

As a background for discussing these characteristics, it is useful to define a "fill time" for the ionizable gas entering the discharge volume 108. This fill time, T, in seconds is the length, L, in meters of the discharge volume (shown in both FIGS. 1 and 2) divided by the average molecular velocity, v, in meters per second.

$$T=L/v$$

Because the operation is normally in the regime where the mean free path length is of the same order as, or larger than, the width (closed-drift type) or diameter (end-Hall type) of the discharge volume, the temperature of the gas molecules is near equilibrium with the anode temperature.

A commercial Mark II end-Hall ion source, manufactured by Commonwealth Scientific Corporation (and now available from Veeco Instruments Inc.), can be used as a fill-time calculation example. It has a discharge volume length, L, of about 5 cm. At full operating power, the anode is at a temperature of about 500° C. The average molecular velocity of argon (an ionizable gas that is frequently used in industrial applications) is 395 meters per second at 20° C. Corrected to the anode temperature of 500° C., this velocity becomes 642 meters per second. The fill time is thus $$T=0.05/642=7.8\times10^{-5} \text{ seconds or } 0.078 \text{ milliseconds}$$

Figure 6:
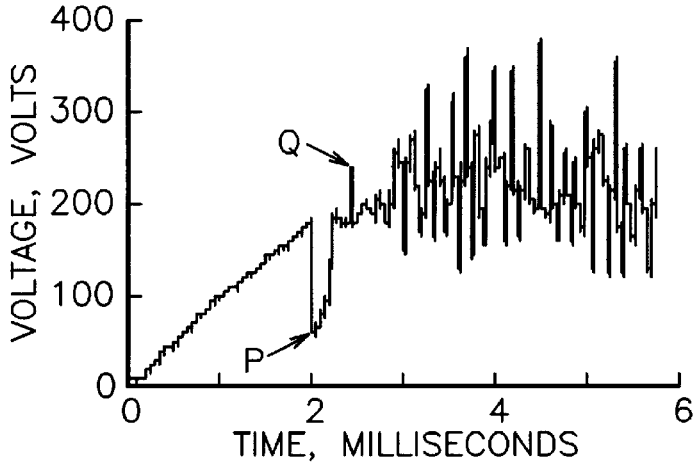
FIG. 6 shows the evolution of discharge voltage of an end-Hall type of Hall-current ion source near the initiation of a discharge pulse.

Referring now to FIG. 6, there is shown the voltage variations obtained with an oscilloscope when a Mark II end-Hall ion source was started with a voltage pulse of long duration. The background pressure is in the mid-$10^{-4}$ Torr range (mid-$10^{-2}$ Pascal range). The mean voltage after starting the discharge, about 200 V, is near the upper limit possible for steady-state operation and typically results in noisy operation. The ion source had been started repetitively so that the anode was near normal operating temperature.

From zero time to 2 milliseconds in FIG. 6, the voltage between the anode and cathode is increasing, but a discharge has not started. There are some initial dynamics in discharge voltage after the discharge starts at 2 milliseconds—the decrease in applied voltage as the current starts to increase (starting at P in FIG. 6) and the small increase in voltage about 0.5 milliseconds after the initiation of discharge current (shown at Q in FIG. 6)—but these are artifacts of the primarily inductive power supply that was used. Ignoring these artifacts, the fluctuations in voltage are small for almost the first millisecond after initiation of the discharge.

Figure 7:
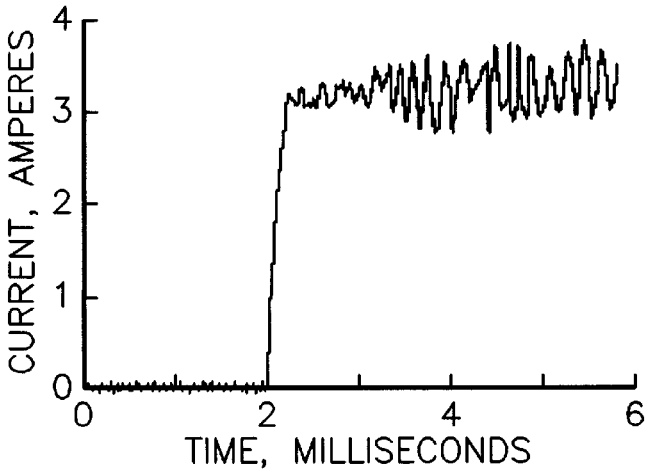
FIG. 7 shows the evolution of discharge current of an end-Hall type of Hall-current ion source near the initiation of a discharge pulse.

The initially quiescent behavior is shown more clearly for the discharge current in FIG. 7, which corresponds to the voltage of FIG. 6. Again there is no discharge from zero to 2 milliseconds. The small variations about zero current during this time interval indicates the level of background electronic noise. At 2 milliseconds, the discharge starts and the current rises rapidly. The quiescent behavior continues for about a millisecond after initiation of the discharge current. After this quiescent period the fluctuations increase by a factor of two or more and remain thereafter at a high value.

The significance of the variations shown in FIGS. 6 and especially FIG. 7 is that a quiescent discharge is obtained initially, and that time is required for the voltage and current fluctuations to reach levels consistent with steady-state operation at the background pressure and discharge voltage that were used. For this application, "quiescent discharge" is defined as operation where the voltage and/or current fluctuations have an amplitude a factor of two or more smaller than the amplitude during steady-state operation at otherwise similar operating conditions. Depending on the characteristics of the discharge power supply, the fluctuations can appear as voltage fluctuations, current fluctuations, or both.

The results shown in FIGS. 6 and 7 are important in that what have been considered "normal" fluctuations require time to develop. This effect has not been mentioned in Hall-current ion-source literature. A less significant, but still interesting result is the dominant frequency of 14–15 kHz for the fully developed fluctuations. This compares favorably with the reciprocal of the fill time, T, equal to $1/0.078\times10^{-5}$ seconds=13 kHz. A dominant frequency that corresponds to the fill time is frequently observed when an ion source is operated near an operational limit due to low gas flow and/or high background pressure. While precise agreement should not be expected for a simple calculation of this type, the fill time, T, is still useful for approximate calculations.

From FIGS. 6 and 7 it is concluded that the pulse duration for a quiescent discharge should be equal to or less than several fill times—in this case about 10 fill times. In general, there should be no reason for such long duration pulses and the upper limit for quiescent operation need not be approached.

Figure 8:
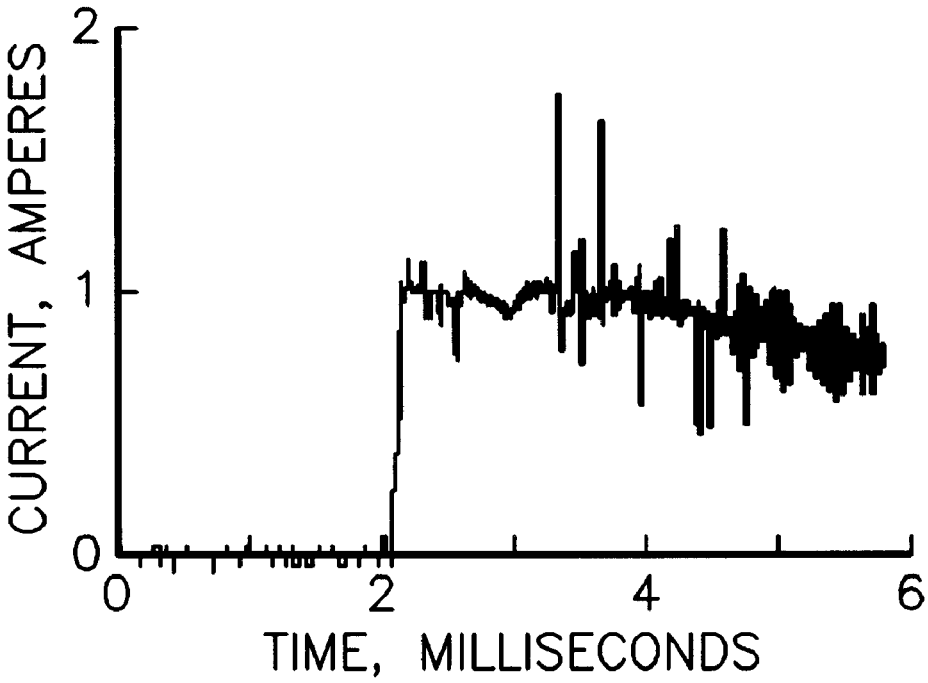
FIG. 8 shows the evolution of discharge current of a closed-drift type of Hall-current ion source near the initiation of a discharge pulse.

The experimental results shown in FIGS. 6 and 7 are for a Hall-current ion source of the end-Hall type, shown in FIG. 1. Similar results were obtained with a Hall-current ion source of the closed-drift type, shown in FIG. 2. The current variations obtained with an oscilloscope when this closed-drift ion source was started with a voltage pulse of long duration are shown in FIG. 8. The initiation of the discharge, shown by the rapid increase in discharge current, is again at a time of 2 milliseconds. In this case, the initially quiescent period extends for about 1.2 milliseconds after initiation of the discharge.

This ion source had a mean diameter of the annular discharge volume 80 of 3 cm and a length, L, of 1.2 cm. The estimated fill time, T, was $2\times10^{-5}$ seconds and the initial quiescent period thus extends for about 60 fill times.

The exact length of the quiescent period after the initiation of a discharge will obviously depend on both the ion source and the operating conditions used. As an approximate upper limit, the quiescent period should not extend beyond about 100 fill times.

If the reduction in neutral gas loss is of interest, the time between pulses should be less than or equal to the fill time. It should be evident that longer times between pulses would result in many gas molecules entering, passing through, and finally leaving the discharge volume, without benefit of a discharge to ionize them.

The need for sufficient electron emission was discussed in connections with FIG. 4 and steady-state operation. There is a similar need for the cathode to be capable of supplying an electron emission equivalent to the peak anode current during a pulse. With a hot-filament cathode, this extra emission is provided by a sufficient increase in heating power. The lack of sufficient electron emission capability is indicated by a cathode emission current that fails to "track" the anode current near peak values. If the cathode emission is substantially less than the current to the anode, the deficiency in electrons must be made up from the vacuum chamber. This takes place by the vacuum chamber becoming filled with a plasma at a potential that is sufficiently elevated to draw electrons from surrounding vacuum-chamber hardware—usually in the form of many small; short-duration arcs. This mode of operation does not generate a directed ion beam and is generally not of interest.

A variety of pulse shapes were tested. It may be satisfying from a theoretical viewpoint to use essentially rectangular voltage-pulse shapes. However, it is generally just as effective from the ion-beam application viewpoint to use other more shapes.

Experimentally, the benefits of pulsed operation of a Hall-current ion source can be obtained in various ways. Operation at a reduced flow of ionizable gas is possible for a normal background pressure—typically less than $5\times10^{-3}$ Torr, or 0.7 Pascal, with argon. Pulsed operation permits operation at higher discharge voltages than would be possible with steady-state operation in the low-$10^{-4}$ to high-$10^{-3}$ Torr range of background pressure investigated herein. It may therefore be possible to use pulsed operation at a background pressure that is too high (e.g., $>10^{-3}$ Torr with argon) for steady-state operation.

These benefits result from the more efficient containment and use of electrons that in turn result from the decreased discharge fluctuations, which in turn permit the generation of ions at a lower density of ionizable gas than would be possible in steady-state operation. They also result from the buildup between pulses of ionizable gas density in the discharge volume to a higher level than would occur if ions were simultaneously being generated and accelerated to form the ion beam.

While particular embodiments of the present invention have been shown and described, and various alternatives have been suggested, it will be obvious to those of ordinary skill in the art that changes and modifications may be made without departing from the invention in its broadest aspects. Therefore, the aim in the appended claims is to cover all such changes and modifications as fall within the true spirit and scope of that which is patentable.

We claim:

1. A Hall-current ion source apparatus comprising:

a Hall-current ion source comprising a discharge volume wherein ions are generated, an electron-emitting cathode and an anode;

means for supplying a flow of ionizable gas to said ion source;

first power-supply means for applying pulses of discharge voltage, of a polarity and magnitude sufficient to initiate a discharge between said cathode and said anode of said ion source and where the duration of said voltage pulses is short compared to the time between pulses; and second power-supply means for energizing said cathode to assure electron emission capability at least equal to the maximum discharge current of said first power supply means.

2. A Hall-current ion source apparatus comprising:

a Hall-current ion source comprising a discharge volume wherein ions are generated, an electron-emitting cathode and an node;

means for supplying a flow of ionizable gas to said ion source;

first power-supply means for applying pulses of discharge voltage, of a polarity and magnitude sufficient to initiate a discharge between said cathode and said anode of said ion source and where the duration of said voltage pulses is short enough to assure a quiescent discharge; and second power-supply means for energizing said cathode to assure electron emission capability at least equal to the maximum discharge current of said first power supply means.

3. A Hall-current ion source apparatus as defined in claim 1 or 2, further characterized by the duration of said voltage pulses being equal to or less than 100 fill times for said ionizable gas in said discharge volume of said Hall-current ion source.

4. A Hall-current ion source apparatus as defined in claims 1 or 2, further characterized by the duration between said voltage pulses being equal to or less than about one fill time for said ionizable gas in said discharge volume of said Hall-current ion source.

5. A method for ionizing an ionizable gas in a Hall-current ion source of the type including:

a cathode capable of electron emission;

a discharge volume for generating ions;

an anode adjacent to said discharge volume;

wherein the method comprises the steps of:

a. introducing an ionizable gas into said discharge volume;

b. providing a pulsed power-supply means between said cathode and the anode of said ion source wherein the voltage pulse is sufficient to initiate a discharge between said cathode and said anode;

c. providing a power-supply means for the cathode sufficient to assure electron emission capability equal to or greater than the maximum anode current required; and d. providing a length of said voltage pulse that is sufficiently short to assure a quiescent discharge.

6. A method in accordance with claim 5 in which the duration said voltage pulse is equal to, or less than, 100 fill times for said ionizable gas in said discharge volume of said Hall-current ion source.

7. A method in accordance with claim 5 comprising the additional step:

a. providing a duration between pulses equal to, or less than, about one fill time for said ionizable gas in said discharge volume of said Hall-current ion source.

8. A method for operating a Hall-current ion source at a educed flow of ionizable gas wherein said ion source includes:

a cathode capable of electron emission;

a discharge volume for generating ions;

an anode adjacent to said discharge volume; and wherein the method comprises the steps of:

a. providing a pulsed power-supply means between said cathode and said anode of said ion source wherein the voltage pulse is sufficient to initiate a discharge between said cathode and said anode;

b. providing a power-supply means for the cathode sufficient to assure electron emission capability equal to or greater than the maximum anode current required; and c. providing voltage pulse length approximately equal to, or less than, about one fill time for said ionizable gas in said discharge volume of said Hall-current ion source.

9. A method for operating a Hall-current ion source at a high background pressure wherein said ion source includes:

a cathode capable of electron emission;

a discharge volume for generating ions;

an anode adjacent to said discharge volume; and wherein the method comprises the steps of:

a. providing a pulsed power-supply means between said cathode and said anode of said ion source wherein the voltage pulse is sufficient to initiate a discharge between said cathode and said anode;

b. providing a power-supply means for the cathode sufficient to assure electron emission capability equal to or greater than the maximum anode current required; and c. providing a length of said voltage pulse that is sufficiently short to assure a quiescent discharge.

* * * * *